United States Patent [19]

Yoshida

[11] 4,424,778

[45] Jan. 10, 1984

[54] COUPLER FOR USE IN AN OIL COOLING SYSTEM

[76] Inventor: Minoru Yoshida, 275 E. Bloom Dr., Monterey Park, Calif. 91754

[21] Appl. No.: 429,117

[22] Filed: Sep. 30, 1982

[51] Int. Cl.[3] ..... F01M 1/00

[52] U.S. Cl. ..... 123/196 AB; 123/196 R; 123/41.33; 123/41.31; 184/104 B; 165/41; 137/563

[58] Field of Search ..... 123/196 AB, 196 R, 41.51, 123/41.31, 41.33, 41.52; 184/104 B, 6.5; 285/177, 137, 169; 165/41; 137/563

[56] References Cited

U.S. PATENT DOCUMENTS 3,223,197 12/1965 Conover et al. ..... 184/104 B 3,777,847 12/1973 Lawless ..... 123/196 R 4,287,908 9/1981 Storgard ..... 137/563

*Primary Examiner*—Charles J. Myhre

*Assistant Examiner*—E. Rollins Cross

*Attorney, Agent, or Firm*—Koda and Androlia

[57] ABSTRACT

A coupler for use in an oil system for an engine which includes a first oil cooler provided adjacent the engine and a second oil cooler provided remotely from the engine. The coupler includes a housing, a first passageway in the housing for coupling an oil output port of the engine to an input oil port of the first oil cooler, a second passageway in the housing for coupling an oil output port of the first oil cooler to an oil input port of the second oil cooler and a third passageway in the housing for coupling an oil output port of the second oil cooler to an oil inport of the engine whereby the first and second oil coolers are connected in series.

4 Claims, 3 Drawing Figures

COUPLER FOR USE IN AN OIL COOLING SYSTEM

BACKGROUND OF THE INVENTION

1. Field of Invention

This invention relates to oil cooling systems and more particularly to oil cooling systems for internal combustion engines which have remotely provided oil coolers.

2. Description of Prior Art

Many internal combustion engines for motor vehicles are provided with engine oil coolers, particularly air cooled engines wherein the temperature of the oil is a very important factor in determining the temperature of the engine. Such engine oil coolers are typically provided in the engine compartment and are exposed to the air flow from the engine fan so that the oil cooler is constantly exposed to a flow of air created by the engine fan so as to cool the engine oil.

With the advent of off the road vehicles and tighter emission controls systems which both result in higher engine oil temperatures, it has become advantageous to add larger engine oil coolers since the original oil cooler frequently proves to be inadequate because of its small size and capacity. Since the replacement oil coolers are larger and the space in engine compartments is limited, such replacement engine oil coolers must be provided remotely from the engine. Furthermore, since the air in the engine compartment is typically hot and the exterior is exposed to large air flow of relatively cool air, such replacement oil coolers are usually provided remotely on the body or frame of the motor vehicle where they are exposed to the exterior air flow created by the motor vehicle moving through the air.

While such remotely installed replacement oil coolers provide the additional engine oil cooling, they possess certain disadvantages. The primary disadvantage is that since they are only exposed to the air flow created by the motor vehicle moving through the air, when the motor vehicle is stationary, such as in heavy traffic, the cooling done by these replacement oil coolers can also become inadequate with a resulting overheating of the motor vehicle. As of the present time this disadvantage has not been overcome since the coupling of the remotely provided replacement oil cooler to the engine of the motor vehicle requires that the original cooler be eliminated completely. Therefore, when a replacement oil cooler of larger size is provided, no oil cooler is coupled to the engine which is exposed to the air flow created by the engine fan.

SUMMARY OF THE INVENTION

Accordingly it is the general object of the first invention to provide a means whereby the disadvantages of the prior art are overcome.

It is another object of the present invention to provide a coupler which allows the original oil cooler to be utilized when a remotely provided auxilary oil cooler is coupled to the engine.

In keeping with the principles of the present invention, the objects are accomplished by a unique coupler for use in an oil cooling system for an engine having oil input and output ports which includes a first oil cooler having oil input and output ports provided adjacent the engine and a second oil cooler having oil input and output ports provided remotely from the engine. The coupler includes a housing, a first passageway in the housing for coupling the oil output port of the engine to the oil input port of the first oil cooler, a second passageway in the housing for coupling the oil output port of the first oil cooler to the oil input port of the second oil cooler and a third passageway in the housing for coupling the oil output port of the second oil cooler to the oil input port of the engine. With such a coupling the first and second oil coolers can be connected in series and adequate oil cooling provided for the engine under all conditions.

BRIEF DESCRIPTION OF THE DRAWINGS

The above mentioned features and objects of the present invention will become more apparent with reference to the following description taken in conjunction with the accompanying drawings, wherein like reference numerals denote like elements and in which.

DETAILED DESCRIPTION OF THE INVENTION

Figure 1:
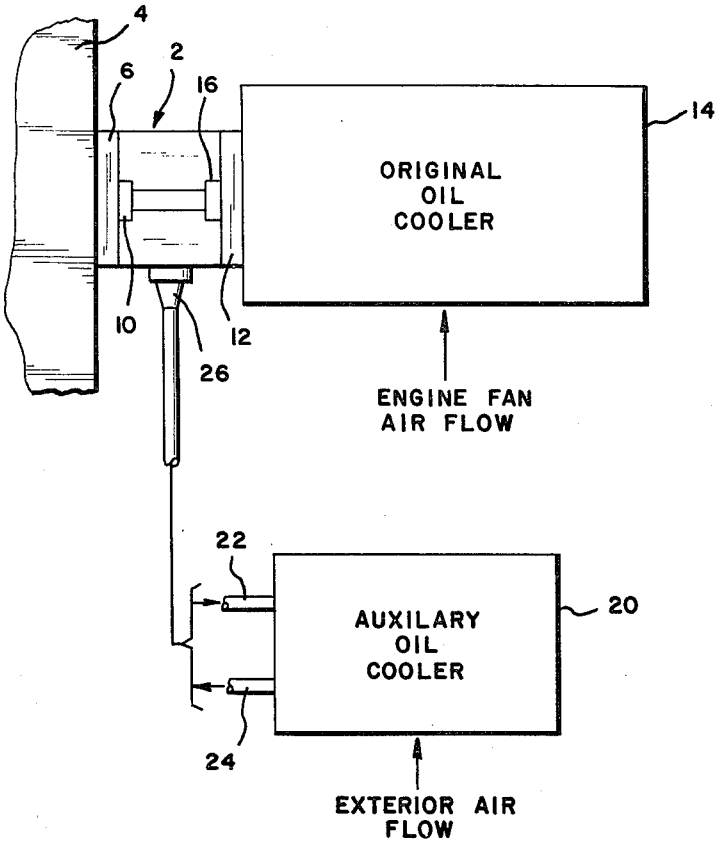
FIG. 1 is a top plan view illustrating the physical construction of an oil cooling system utilizing the coupler of the present invention.
Figure 2:
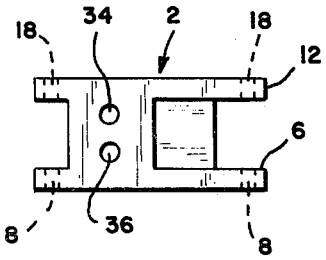
FIG. 2 is a side plan view of a coupler in accordance with the teachings of the present invention.

Referring particularly to the figures, shown therein is a coupler 2 in accordance with the teachings of the present invention. The coupler 2 is coupled to the engine 4. In particular the coupler 2 is provided with a bottom flange 6 having holes 8. The engine 4 is typically provided with a flat surface with oil input and output oil ports to which the original oil cooler is coupled. In addition, the surface on which the original oil cooler is usually connected is typically provided with threaded holes so that the original oil cooler can be bolted to the engine. Therefore, the holes 8 in the bottom flange 6 of the coupler 2 are arranged such that they correspond to the hole pattern in the engine 4 and the coupler 2 is coupled to the engine utilizing bolts 10.

The coupler 2 is also provided with a top flange 12 to which the original oil cooler 14 is coupled. The original oil cooler 14 is coupled to the top flange 12 by means of bolts 16 which extend through holes 18 in the top flange of the coupler 2.

The auxilary oil cooler 20 is typically provided remotely from the engine at a point on the body of the vehicle or frame of the vehicle wherein a large amount of exterior air flow would pass through the auxilary oil cooler 20. The auxilary oil cooler 20 is then coupled to the coupler 2 by means of oil lines 22 and 24 which in turn are coupled to the coupler 2 by means of screw fittings 26. With this construction and utilizing the coupler 2 of the present invention, the original oil cooler 14 can be utilized together with an auxilary oil cooler 20.

Figure 3:
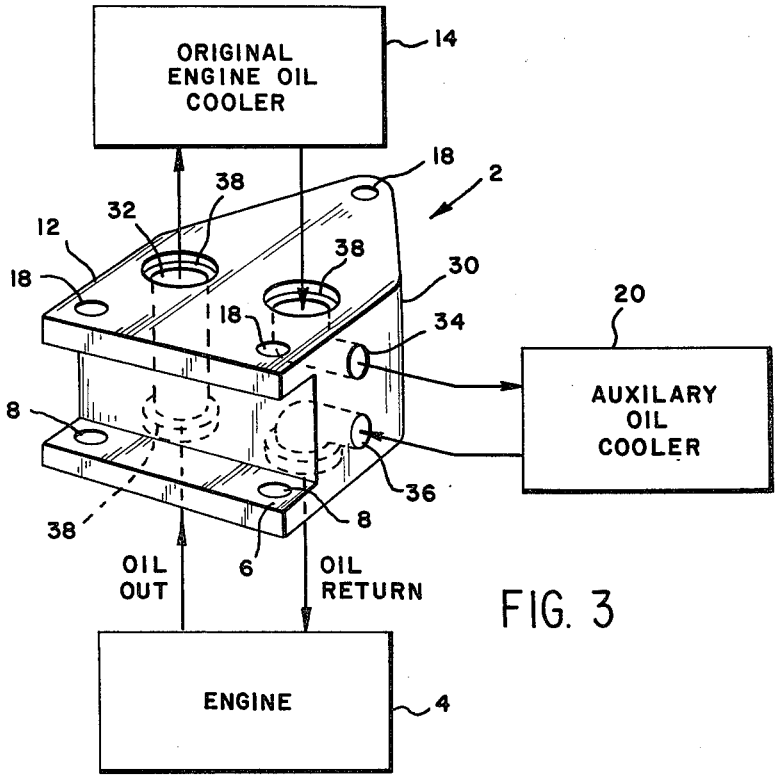
FIG. 3 is a combination perspective and block diagram illustrating the physical construction of the coupler of the present invention and the oil flow in an oil cooling system utilizing the coupler of the present invention.

Referring particularly to FIG. 3, shown therein is one preferred construction of the coupler 2 of the present invention. In particular the coupler 2 includes a housing body 30 which is provided with a first passageway 32 for coupling the oil output port of the engine 4 to the oil input port of the original engine oil cooler 14. The housing 30 is further provided with a second oil passageway 34 which is generally elbow shaped and which couples the oil output port of the original engine oil cooler 14 to the oil input port of the auxilary oil cooler 20. In addition the housing 30 is provided with a third passageway 36 which is also generally elbow shaped which couples the oil output port of the auxilary oil cooler to the oil input port or oil return of the engine 4. In addition for the purposes of oil tightness, the bottom and top flanges 6 and 12 are each provided with O ring seats 38 which surround the ends of the first, second and third passageways 32, 34 and 36 which are in fluid coupling with either the original oil cooler or the engine. In these O ring seats 38 are provided O rings to provide the required oil tightness. In addition those ends of the second and third oil passageway 34 and 36 which are coupled to the auxilary oil cooler are also threaded so that the oil fitting 26 may be screwed therein.

In operation, oil under pressure flows out of the output oil port of the engine 4, through the first passageway 32 to the input port of the original oil cooler 14. The oil then flows from the original oil cooler 14 through the second passageway 34 to the auxilary oil cooler 20. Next the oil flows from the auxilary oil cooler 20 through the third passageway 36 and to the oil input port of the engine 4. In this way the oil flows in series and constantly through both the original oil cooler 14 and the auxilary oil cooler 20. Therefore, the original oil cooler 14 is always exposed to an airflow created by the engine fan and the auxilary oil cooler 20 which is remotely provided from the engine 4 is exposed to the exterior airflow created by the movement of the motor vehicle through the air. As a result, adequate oil cooling during high load requirements when the motor vehicle is moving is provided by the auxilary oil cooler 20 while adequate oil cooling is provided by the orignial oil cooler 14 when the motor vehicle is not moving and the engine is simply idling.

It should be apparent to those skilled in the art that the shape of the coupler 2 could be any shape and the coupler 2 could be made from any particular temeprature resistant material such as aluminum, steel, high temperature plastic, etc. Furthermore, while the shape and construction of the particular oil passageways in the coupler 2 has been described with a particular configuration, it would also be possible to use some other configuration so long as the original oil cooler 14 and the auxilary oil cooler are connected in series. Furthermore, in some instances, it may be required that the original oil cooler 14 be coupled to the coupler 12 by means of oil lines and the engine 4 be coupled to the coupler 2 by means of oil lines.

It should be apparent to those schooled in the art that the above described embodiment is really descriptive of but one of the many possible specific embodiments which incorporate the principles of the present invention. Numerous and varied other instruments could be readily devised by those skilled in the art without departing from the spirit and scope of the invention.

I claim:

1. A coupler for use in an oil cooling system for an engine having oil input and output ports which includes a first oil cooler having oil input and output ports and a second oil cooler having oil input and output ports provided remotely from the engine, said coupler comprising:

a housing;

a first passageway in said housing for coupling the oil output port of said engine to said input oil port of said first oil cooler;

a second passageway in said housing for coupling said oil output port of said first oil cooler to said oil input port of said second oil cooler;

a third passageway in said housing for coupling the oil output port of said second oil cooler to said input oil port of said engine;

whereby said first and second oil coolers are connected in series.

2. A coupler according to claim 1 wherein said first oil cooler is coupled directly to said coupler.

3. A coupler according to claim 2 wherein said first oil cooler is provided in an air flow created by said engine, and said second oil cooler is exposed to an air flow not created by said engine.

4. A coupler according to claim 3 wherein both said second and third passageways are elbow shaped and said first passageway is straight.

* * * * *